US008650919B2

(12) United States Patent
Liu

(10) Patent No.: US 8,650,919 B2
(45) Date of Patent: Feb. 18, 2014

(54) ANTI-BREAK LOCK

(76) Inventor: Tien-Kao Liu, Pingtung County (TW)

( * ) Notice: Subject to any disclaimer, the term of this patent is extended or adjusted under 35 U.S.C. 154(b) by 0 days.

(21) Appl. No.: 13/478,256

(22) Filed: May 23, 2012

(65) Prior Publication Data

US 2013/0312467 A1 Nov. 28, 2013

(51) Int. Cl.
*E05B 9/04* (2006.01)

(52) U.S. Cl.
USPC ..... 70/493; 70/367; 70/369; 70/372; 70/373; 70/379 R; 70/380; 70/421; 70/DIG. 35; 70/DIG. 60

(58) Field of Classification Search
USPC .... 70/493, 419, 421, DIG. 60, 379 R, 379 A, 70/380, 367–375, 451, DIG. 35, 447–449, 70/466
See application file for complete search history.

(56) References Cited

U.S. PATENT DOCUMENTS

| | | | | | |
|---|---|---|---|---|---|
| 1,707,922 | A * | 4/1929 | Pepper | 70/421 |
| 3,293,892 | A * | 12/1966 | Falk | 70/493 |
| 3,824,818 | A * | 7/1974 | Neale | 70/358 |
| 3,974,671 | A * | 8/1976 | Rossetti | 70/375 |
| 4,031,729 | A * | 6/1977 | Gretler | 70/380 |
| 4,195,504 | A * | 4/1980 | Foshee | 70/369 |
| 4,292,824 | A * | 10/1981 | Keller | 70/373 |
| RE31,791 | E * | 1/1985 | Dice, Sr. | 70/421 |
| 4,580,425 | A * | 4/1986 | Smith | 70/421 |
| 4,961,328 | A * | 10/1990 | Mundhenke | 70/1.5 |
| 5,479,801 | A * | 1/1996 | Keller | 70/373 |
| 5,501,087 | A * | 3/1996 | Keller | 70/370 |
| 5,666,835 | A * | 9/1997 | Keller | 70/397 |
| 6,532,781 | B1 * | 3/2003 | Keller | 70/358 |
| 6,601,419 | B2 * | 8/2003 | Huang et al. | 70/358 |
| 7,591,160 | B2 * | 9/2009 | Keller | 70/277 |
| 7,637,131 | B2 * | 12/2009 | Amir | 70/277 |
| 8,186,193 | B2 * | 5/2012 | Huang et al. | 70/375 |
| 8,336,349 | B2 * | 12/2012 | Thimmappa et al. | 70/371 |
| 2004/0003634 | A1 * | 1/2004 | Keller | 70/380 |
| 2004/0172993 | A1 * | 9/2004 | Furlong | 70/379 R |
| 2005/0011239 | A1 * | 1/2005 | Lurie et al. | 70/369 |
| 2007/0209416 | A1 * | 9/2007 | Kim | 70/371 |
| 2011/0154871 | A1 * | 6/2011 | Huang et al. | 70/375 |
| 2013/0061643 | A1 * | 3/2013 | Chen | 70/276 |

* cited by examiner

*Primary Examiner* — Lloyd Gall
(74) *Attorney, Agent, or Firm* — Rosenberg, Klein & Lee

(57) ABSTRACT

An anti-break lock includes a body and two rods respectively extend from two ends of the body. Two rings extend radially from the body. The body has a passage which communicates with one of the rings and the ring is engaged with an engaging block. The engaging block has a recess in which a pad is received. The passage has a resilient member and a stop pin received therein and the stop pin has a first shoulder and a second shoulder formed in two ends thereof. A contact portion extends from the second shoulder. The body has a room which communicates with the passage. A resilient piece and an engaging member are received in the room. When the lock is damaged, the contact portion is inserted into the recess and stopped by the engaging member so that it cannot move back to its initial position. The lock cannot be unlocked.

14 Claims, 14 Drawing Sheets

ANTI-BREAK LOCK

FIELD OF THE INVENTION

The present invention relates to a lock, and more particularly, to an anti-break lock which prevents the lock from being unlocked even if the core is taken out.

BACKGROUND OF THE INVENTION

The conventional lock is disclosed in FIGS. 1 and 2, and generally includes a lock case 10 with a hole 101 defined therethrough. The case 10 has a space and a cam 20 is engaged with the space. Two cores 30 are connected to two ends of the cam 20 respectively and located in the case 10. A gap 102 is defined between the case 10 and the cam 20 and a positioning plate 103 is located in the gap 102 so as to position the cam 20 and the cores 30. The lock is connected to an object via the hole 101.

However, the unauthorized persons usually pick the top beads and the bottom beads in the cores 30 and to rotate the cam 20 to unlock the lock. If the arrangement of the top beads and the bottom beads is too complicated, the unauthorized persons break the case 10 at the position where the hole 101 is located as shown in FIG. 3 and the cores 30 are taken out or exposed, the cam 20 is then rotated to unlock the lock. This is to say, the lock can be unlocked if the case 10 is broken and the cores 30 are taken out. Furthermore, because each lock has a specific key which is shaped to match with the movement of the top and bottom beads, so that when the cores 30 are to be replaced, the whole case 10 has to be replaced too. This makes the maintenance cost high and the manufacturers have to prepare sufficient parts for maintenance.

The regulations for locks require the locks to have certain unlock times, levels of durability, fire-proof, the number of parts, material and specification. However, for combination locks, the small sized locks are difficult to obtain the required sets of combination numbers which need at least five sets of top and bottom beads. As shown in FIG. 2, when assembling the cores 30 and the cam 20 to the case 10, the positioning plate 103 is used in the gap 102 to position the cam 20 and the cores 30. The gap 102 restricts the length of the lock so that only four sets of top and bottom beads can be installed. The less number of the top and bottom beads cannot meet the requirements and the locks are easily unlocked.

The present invention intends to provide an anti-break lock which prevents the core from being unlocked even if the core is taken out.

SUMMARY OF THE INVENTION

The present invention relates to an anti-break lock and comprises a case having a body and a fixing hole defined through the body. Two rods respectively extend from two ends of the body and two rings extend radially from the body. The axis of the rings and the axis of the rods are parallel to each other. A space is defined between the two rings.

Preferably, the body has at least one passage which communicates with one of the rings. The ring is engaged with an engaging block. The engaging block has a recess which is located corresponding to the at least one passage and smaller than the at least one passage. A pad is engaged with the recess. The at least one passage is located at one end of the body and a resilient member and a stop pin are received in the at least one passage. The resilient member biases the stop pin which has a first shoulder defined in the first end thereof and facing the resilient member. A second shoulder is defined in the second end of the stop pin and located corresponding to the at least one passage and the recess. A contact portion extends from the second shoulder and is located corresponding to the recess. The body has a room which communicates with the at least one passage. A resilient piece and an engaging member are received in the room. The engaging member is located corresponding to the first shoulder and biased by the resilient piece to contact the stop pin. The contact portion contacts the pad which is removed from the recess. The stop pin is then pushed by the resilient member to insert the contact portion into the recess. The stop pin is then removed from the room. The engaging member is biased by the resilient piece and passes through the conjunction portion between the at least one passage and the room. The first shoulder of the stop pin is stopped by the engaging member and cannot move to its initial position.

Preferably, a cam is located in the space and connected to the engaging block. The engaging block has a core installed thereto which is located corresponding to the cam. The pad is pushed by the contact portion and in contact with the core. The engaging block has a stepped surface in axial direction and a slot. A driving member is located in the engaging block and has a protrusion located corresponding to the slot. The cam has an engaging portion located corresponding to the stepped surface. The engaging block and the cam are connected to each other. The cam has an insertion path defined in the inner periphery thereof and the insertion path is located corresponding to the protrusion. The core has a slide slot which is located at an end of the core that is connected to the engaging block.

Preferably, the body has two passages which are located symmetrically to each other and the engaging blocks are engaged with the rings. The engaging blocks are located symmetrically to each other. Each of the cores has a push member which contacts the driving member and the two driving members are located symmetrically to each other. Each of the driving members has a central hole and a link extends through the central holes so as to move the driving members. When one of the push members is pushed, the driving member pushes the protrusion of the other driving member to be removed from the insertion path.

Preferably, a sleeve is connected to the rod which has at least one pin hole. The sleeve has a connection hole which is located corresponding to the at least one pin hole. A positioning pin extends through the at least one pin hole and the connection hole.

Preferably, the rod has a sleeve mounted thereto which receives the core. The rings are respectively mounted to the cores. The sleeve has at least one slit and the core has a groove which is located corresponding to the at least one slit. The groove has a positioning plate extending therefrom and the positioning plate reaches the sleeve. The positioning plate has two notches. The groove has two locking pieces on two ends thereof and the locking pieces are fixed to the notches.

Alternatively, the present invention provides an anti-break lock and comprises a case having a body and two rings extend radially from the body. A space is defined between the two rings. The body has at least one passage which communicates with one of the rings. The ring is engaged with an engaging block. The engaging block has a recess which is located corresponding to the at least one passage and smaller than the at least one passage. A pad is engaged with the recess. The at least one passage is located at one end of the body and a resilient member and a stop pin are received in the at least one passage. The resilient member biases the stop pin which has a first shoulder defined in the first end thereof which faces the resilient member, and a second shoulder is defined in the second end of the stop pin and located corresponding to the at least one passage and the recess. A contact portion extends from the second shoulder and is located corresponding to the recess. The body has a room which communicates with the at least one passage. A resilient piece and an engaging member are received in the room. The engaging member is located corresponding to the first shoulder and biased by the resilient piece to contact the stop pin. The contact portion contacts the pad which is removed from the recess. The stop pin is then pushed by the resilient member to insert the contact portion into the recess. The stop pin is then removed from the room. The engaging member is biased by the resilient piece and passes through the conjunction portion between the at least one passage and the room. The first shoulder of the stop pin is stopped by the engaging member and cannot move to its initial position.

Preferably, a cam is located in the space and connected to the engaging block. The engaging block has a core installed thereto which is located corresponding to the cam. The pad is pushed by the contact portion and in contact with the core. The engaging block has a stepped surface in axial direction and a slot. A driving member is located in the engaging block and has a protrusion located corresponding to the slot. The cam has an engaging portion located corresponding to the stepped surface. The engaging block and the cam are connected to each other. The cam has an insertion path defined in the inner periphery thereof and the insertion path is located corresponding to the protrusion. The core has a slide slot which is located at an end of the core that is connected to the engaging block.

Preferably, the body has two passages which are located symmetrically to each other and the engaging blocks are engaged with the rings. The engaging blocks are located symmetrically to each other. Each of the cores has a push member which contacts the driving member and the two driving members are located symmetrically to each other. Each of the driving members has a central hole and a link extends through the central holes so as to move the driving members. When one of the push members is pushed, the driving member pushes the protrusion of the other driving member to be removed from the insertion path.

Preferably, a sleeve is connected to the case and has a core received therein. The rings are mounted to the core. The sleeve has at least one slit and the core has a groove which is located corresponding to the at least one slit. The groove has a positioning plate extending therefrom and the positioning plate reaches the sleeve. The positioning plate has two notches. The groove has two locking pieces on two ends thereof and the locking pieces are fixed to the notches.

When the lock is damaged and the core is taken out, the pad is removed from the recess and the stop pin is pushed by the resilient member so that the contact portion is inserted into the recess. Therefore, even if the core is taken out from the lock, the cam is not rotatable so that the lock is not unlocked. Furthermore, when the stop pin is removed from the room, the engaging member is biased by the resilient piece and passes through the conjunction portion between the passage and the room. The first shoulder of the stop pin is stopped by the engaging member and cannot move to its initial position. Accordingly, the unauthorized persons cannot move the stop pin by using a tool. The lock cannot be unlocked from the damaged side, while the owner can unlock the lock from the other side. Besides, desired lengths and numbers of the sleeves and the cores can be assembled to increase the safety feature of the lock.

In addition, the sleeve of the lock of the present invention has a slit and the core has a groove corresponding to the slit. A positioning plate is located in the groove to reduce the length of the sleeve and five sets of top and bottom beads can be installed, so that the lock of the present invention meets the international standard for locks and has satisfied anti-theft feature.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
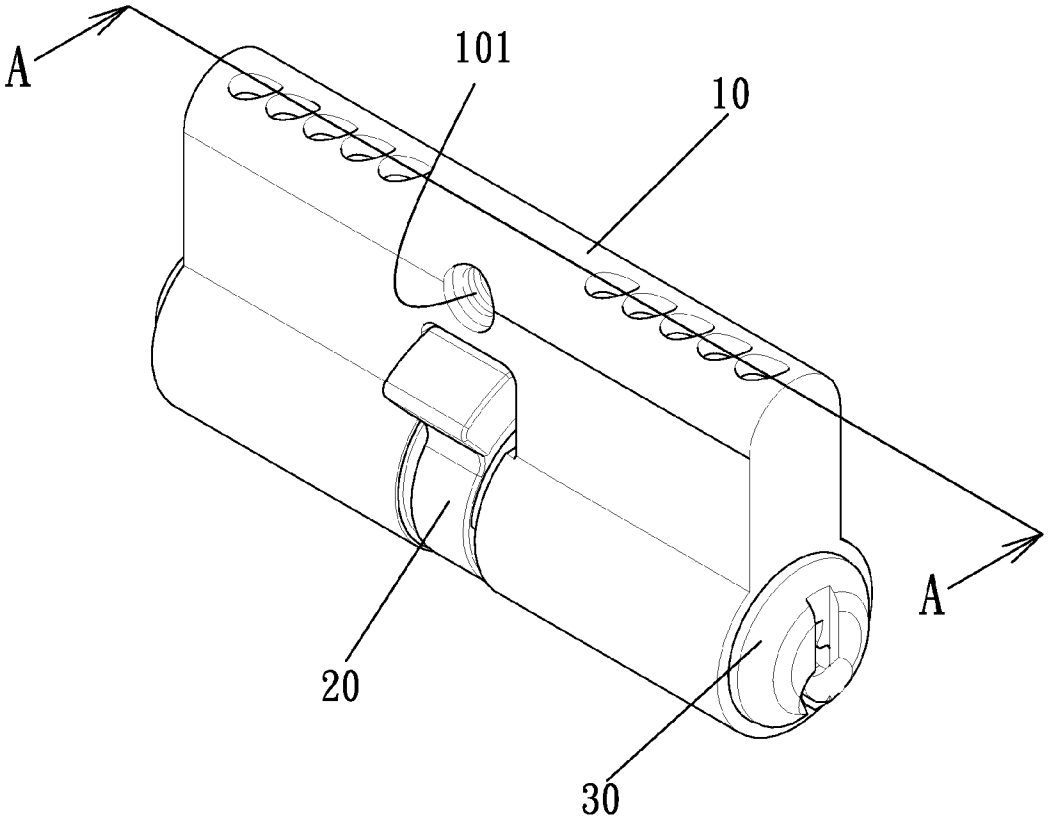
FIG. 1 PRIOR ART
FIG. 1 is a perspective view to show the conventional lock.
Figure 2:
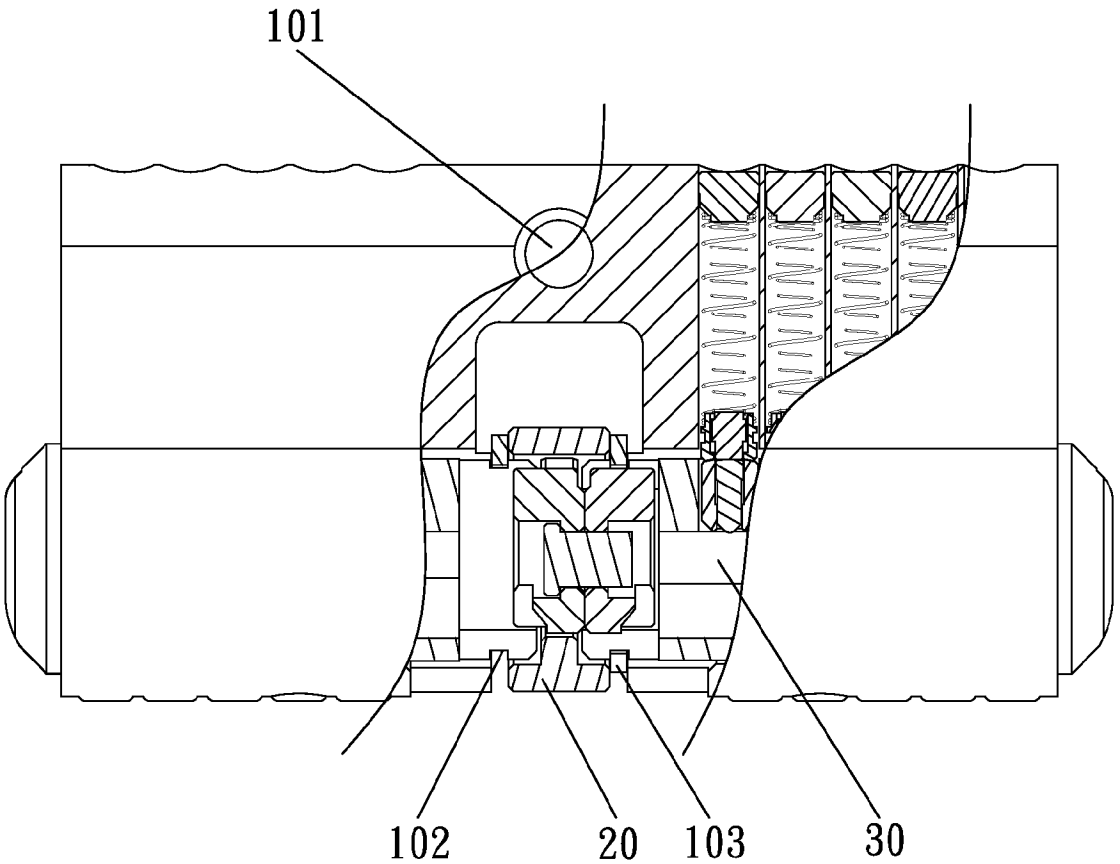
FIG. 2 PRIOR ART
FIG. 2 is a cross sectional view, taken along line A-A in FIG. 1.
Figure 3:
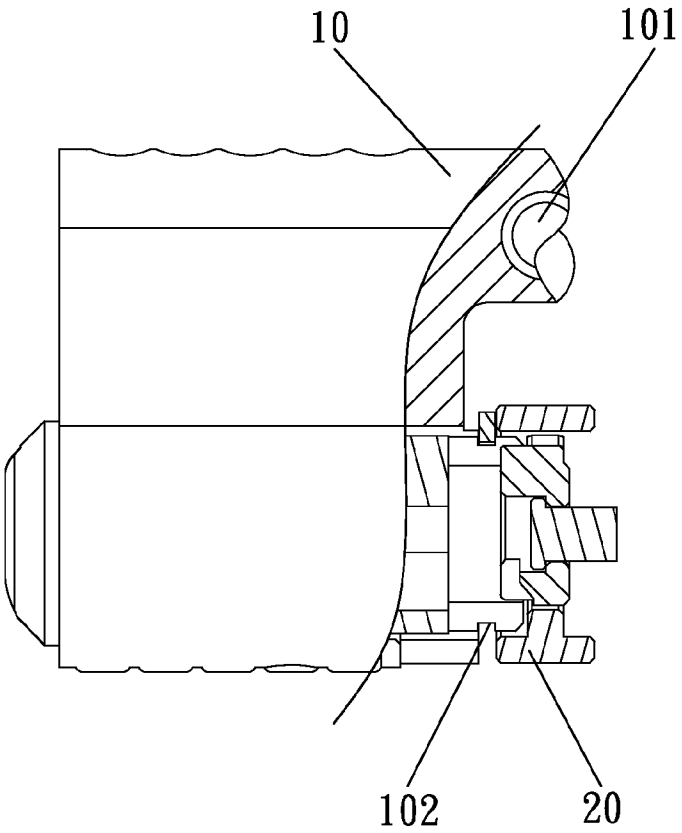
FIG. 3 PRIOR ART
FIG. 3 shows that the conventional lock is damaged and the core is taken out.
Figure 4:
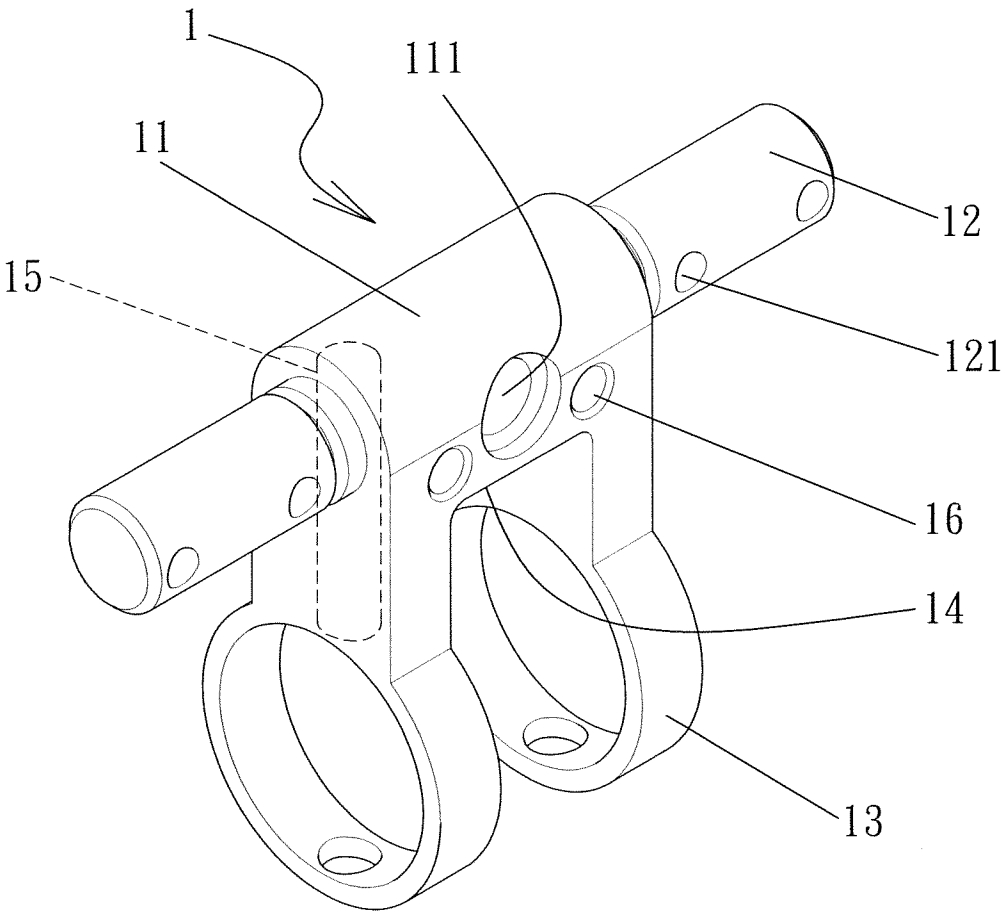
FIG. 4 shows the case of the lock of the present invention.
Figure 5:
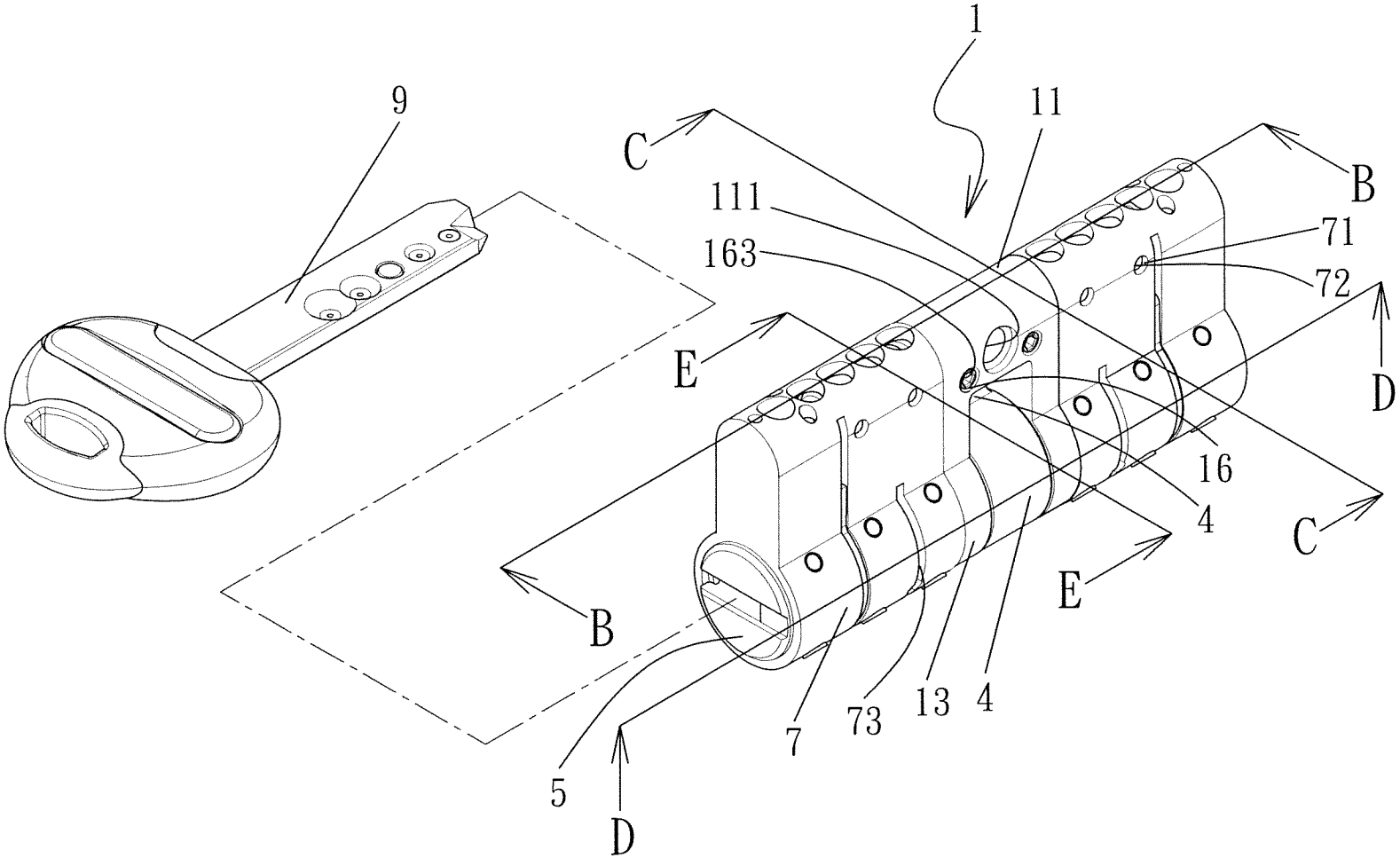
FIG. 5 shows the key and the lock of the present invention.

Referring to FIGS. 4 to 14, the anti-break lock of the present invention comprises a case 1 having a body 11 and a fixing hole 111 is defined through the body 11. The case 1 is fixed to a door or a window by using the fixing hole 111. Two rods 12 respectively extend from two ends of the body 11 and two rings 13 extend radially from the body 11. The axis of the rings 13 and the axis of the rods 12 are parallel to each other. A space 14 is defined between the two rings 13. The body 11 has at least one passage 15 which communicates with one of the rings 13. When the lock has only one passage 15, it means that the lock can only be unlocked from one side by using a key. When the lock has two symmetric passages 15, it means that the lock can be unlocked from either side by using a key. The ring 13 is engaged with an engaging block 2. The engaging block 2 has a recess 21 which is located corresponding to the at least one passage 15 and smaller than the at least one passage 15. A pad 3 is engaged with the recess 21. The at least one passage 15 is located at one end of the body 11 and a resilient member and a stop pin are received in the at least one passage 15. The resilient member 151 biases the stop pin 152 which has a first shoulder 1521 defined in the first end thereof which faces the resilient member 151. A second shoulder 1522 is defined in the second end of the stop pin 152 and located corresponding to the at least one passage 15 and the recess 21. A contact portion 1523 extends from the second shoulder 1522 and is located corresponding to the recess 21. The body 11 has a room 16 which communicates with the at least one passage 15. Each room 16 communicates only one passage 15. A resilient piece 161 and an engaging member 162 are received in the room 16. The engaging member 162 is located corresponding to the first shoulder 1521 and biased by the resilient piece 161 to contact the stop pin 152. The room 16 is defined in one end of the body 11 and a locking member 163 is connected to the body 11 and seals the room 16. The locking member 163 is located corresponding to the engaging member 162.

A cam 4 is located in the space 14 and connected to the engaging block 2. The engaging block 2 has a core 5 installed thereto which is located corresponding to the cam 4. The pad 3 is pushed by the contact portion 1523 and in contact with the core 5. The core 5 has at least one bottom bead 53. The engaging block 2 has a stepped surface 22 in axial direction and a slot 23. A driving member 6 is located in the engaging block 2 and has a protrusion 61 located corresponding to the slot 23. The cam 4 has an engaging portion 41 which is located corresponding to the stepped surface 22. The engaging block 2 and the cam 4 are connected to each other. The cam 4 has an insertion path 42 defined in the inner periphery thereof and the insertion path 42 is located corresponding to the protrusion 61. The core 5 has a slide slot 51 which is located at an end of the core 5, the end of the core is connected to the engaging block 2. The slide slot 51 is located corresponding to the protrusion 61. In the double lock system, the rings 13 are respectively connected with the engaging blocks 2 which are located symmetrically to each other. The driving members 6 (6*a* and 6*b*) are located symmetrically to each other. Each of the cores 5 has a push member 62 which contacts a corresponding one of the two driving members 6 (6*a* and 6*b*). Each of the driving members 6 (6*a* and 6*b*) has a central hole 63. A link 64 extends through the central holes 63 so as to axially move the driving members 6 (6*a* and 6*b*). When one of the push members 62*a* is pushed, the driving member 6*a* axially pushes the protrusion 61*b* of the other driving member 6*b* to be removed from the insertion path 42.

A sleeve 7 is connected to the rod 12 which has at least one pin hole 121. The sleeve 7 has a connection hole 71 which is located corresponding to the at least one pin hole 121. A positioning pin 72 extends through the at least one pin hole 121 and the connection hole 71. The sleeve 7 has at least one top bead 74. The rod 12 has a sleeve 7 mounted thereto which receives the core 5. The rings 13 are respectively mounted to the cores 5. The sleeve 7 has at least one slit 73 and the core 5 has a groove 52 which is located corresponding to the at least one slit 73. The groove 52 has a positioning plate 8 extending therefrom and the positioning plate 8 reaches the sleeve 7. The positioning plate 8 has two notches 82. The groove 52 has two locking pieces 81 on two ends thereof and the locking pieces 81 are fixed to the notches 82.

A key 9 is able to be inserted into the core 5 and pushes the push member 62 when the key 9 is completely inserted into the core 5.

The two rods 12 on the two ends of the case 1 are connected to two sleeves 7 of different lengths, the engaging blocks 2 and the driving members 6 are connected with the cores 5 of different lengths and the cores 5 are located corresponding to the sleeves 7. By the arrangement, multiple combination numbers are available for the lock. The case 1 of the present invention is modularized so as to reduce the cost of inventory. The users can use the original cores 5 and sleeves 7 to be cooperated with the case 1 of the present invention to improve the safety feature. The users do not need to change the cores 5 and keys 9, and this makes the present invention be used in wider range.

Figure 9:
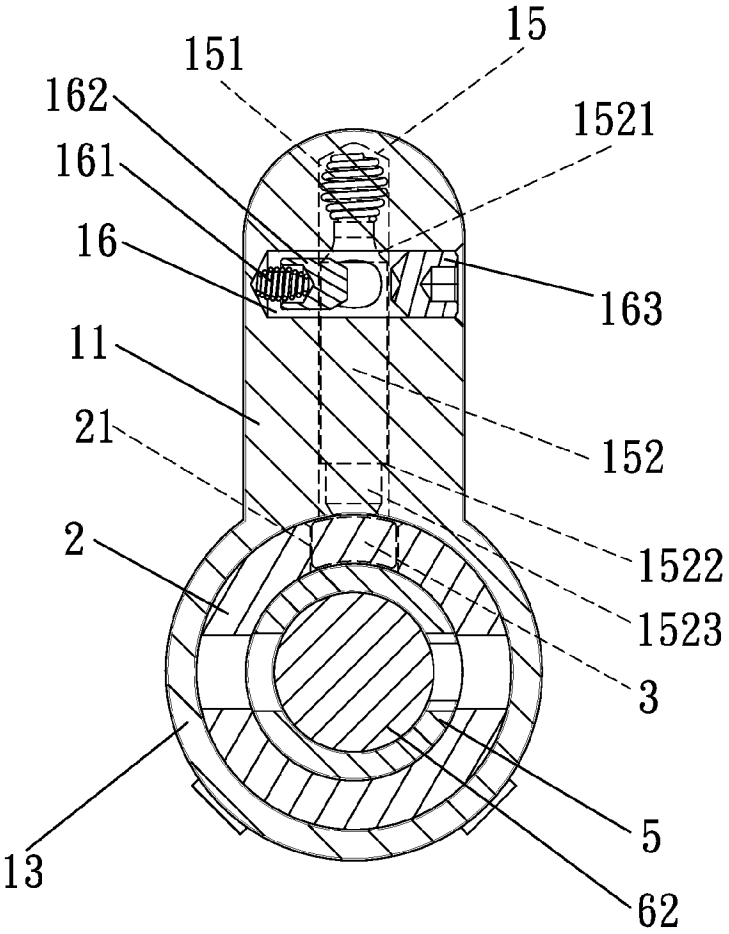
FIG. 9 is a cross sectional view, taken along line C-C in FIG. 5.
Figure 10:
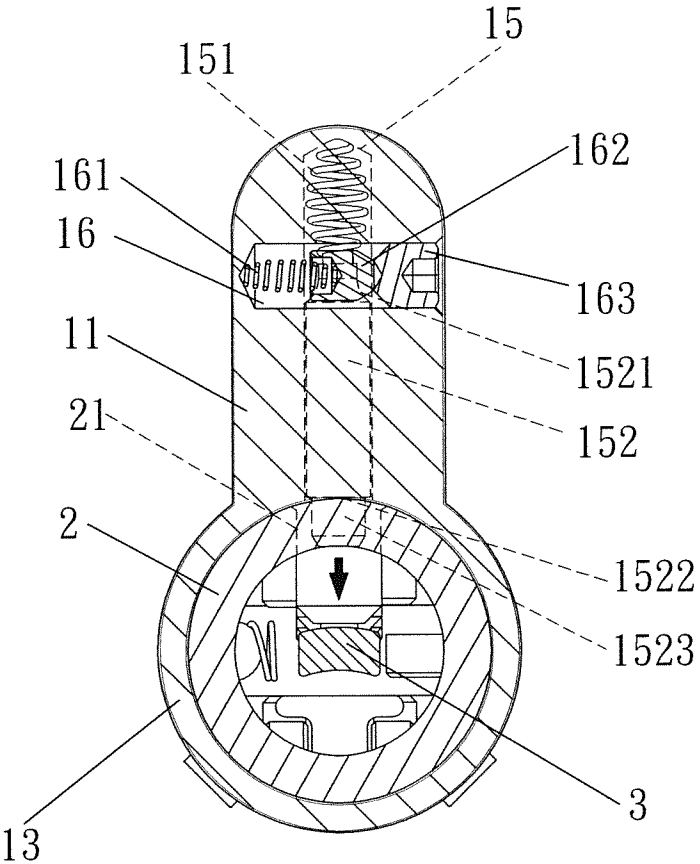
FIG. 10 shows that the sleeve is damaged and the core is taken out.

As shown in FIGS. 4 to 10, when an unauthorized person uses a tool to pick the at least one bottom bead 53 of the core 5, he or she needs to damage the sleeve 7 and separates the sleeve 7 from the rod 12, and the core 5 is taken out. However, the pad 3 is pushed by the contact portion 1523 and contacts the core 5, so that when the core 5 is taken out, the pad 3 is pushed through and away from the recess 21. The stop pin 152 is pushed by the resilient member 151 and the contact portion 1523 is inserted into the recess 21. The engaging block 2 cannot be rotated. The protrusion 61 of the driving member 6 is located corresponding to the slot 23, so that the driving member 6 cannot be rotated and taken out. The unauthorized person cannot rotate the cam 4 to unlock the lock. The recess 21 is smaller than the passage 15, so that the second shoulder 1522 is engaged with the recess 21 and the stop pin 152 does not drop as shown in FIGS. 9 and 10. When the contact portion 1523 is inserted into the recess 21, the stop pin 152 is removed from the room 16 and the engaging member 162 is pushed by the resilient piece 161 and passes through the conjunction portion between the passage 15 and the room 16. The first shoulder 1521 of the stop pin 152 is stopped by the engaging member 162 and cannot move to its initial position. This means that the unauthorized person cannot remove the stop pin 152 from the recess 21 and the lock cannot be unlocked.

Figure 11:
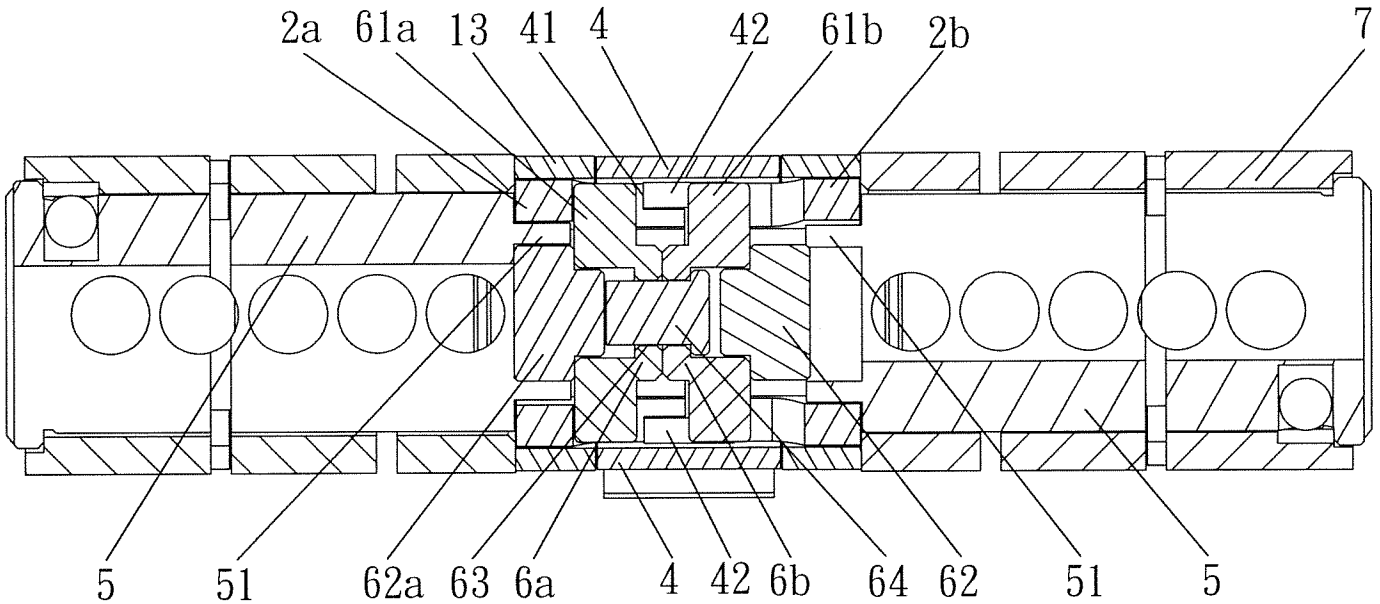
FIG. 11 is a cross sectional view, taken along line D-D in FIG. 5.
Figure 12:
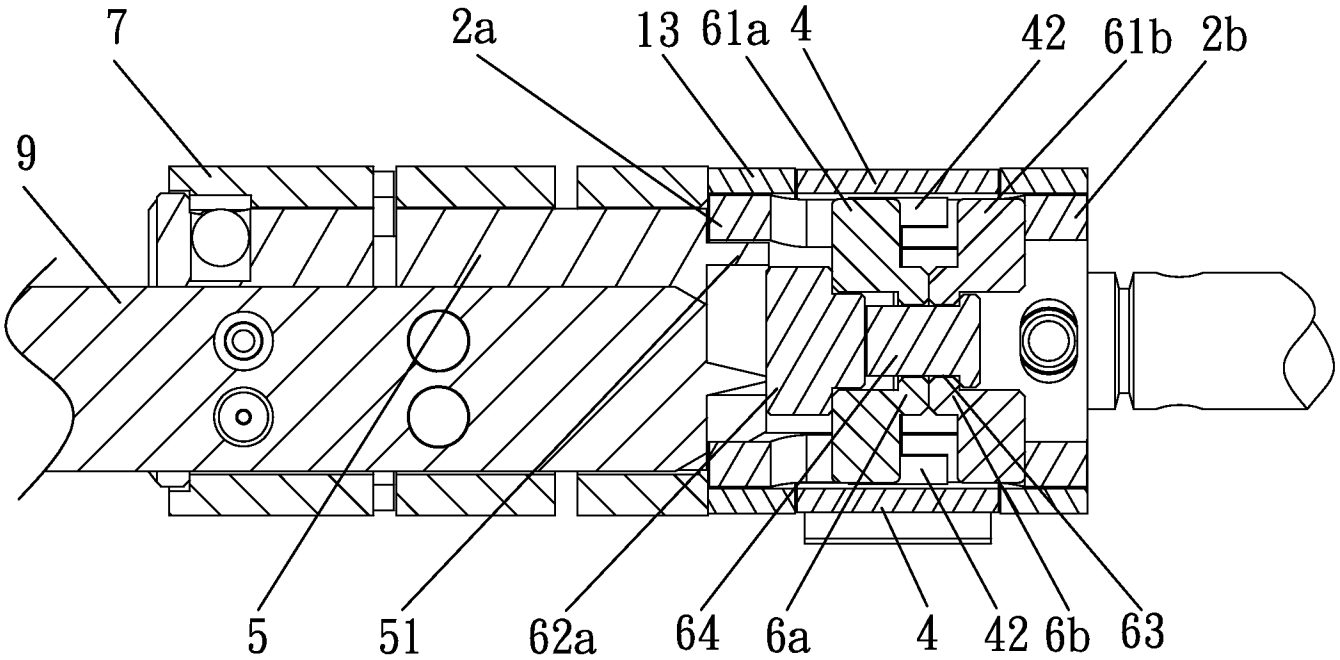
FIG. 12 is a cross sectional view to show that the key is inserted into the lock from the undamaged side thereof.

As shown in FIGS. 11 and 12, when the key 9 is completely inserted into the core 5, one of the push members 62*a* is pushed, the driving member 6*a* pushes the protrusion 61*b* of the other driving member 6*b* to be removed from the insertion path 42. The protrusion 61*a* of the driving member 6*a* is still in the slot 23 and the insertion path 42, and is not affected by the fact that driving member 6*b* cannot rotate because the stop pin 152 is inserted into the recess 21. Therefore, when the key is inserted into the core 5 from the other end of the lock, because the protrusion 61*a* of the driving member 6*a* is located corresponding to the slot 23, the slide slot 51 and the insertion path 42, so that the engaging member 2*a* and the cam 4 can be co-rotated with the driving member 6*a* to unlock the lock.

Figure 6:
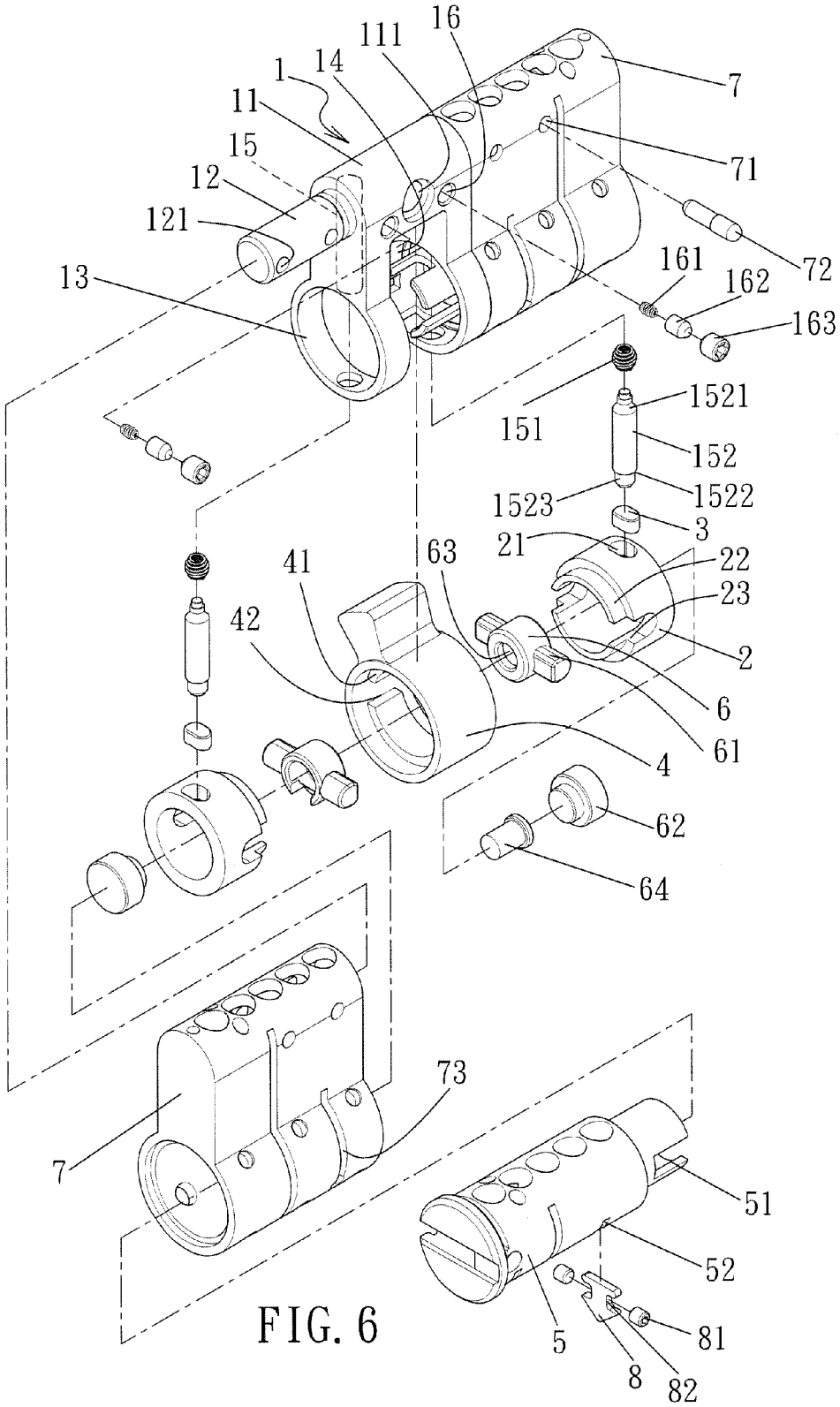
FIG. 6 is an exploded view to show the lock of the present invention.
Figure 7:
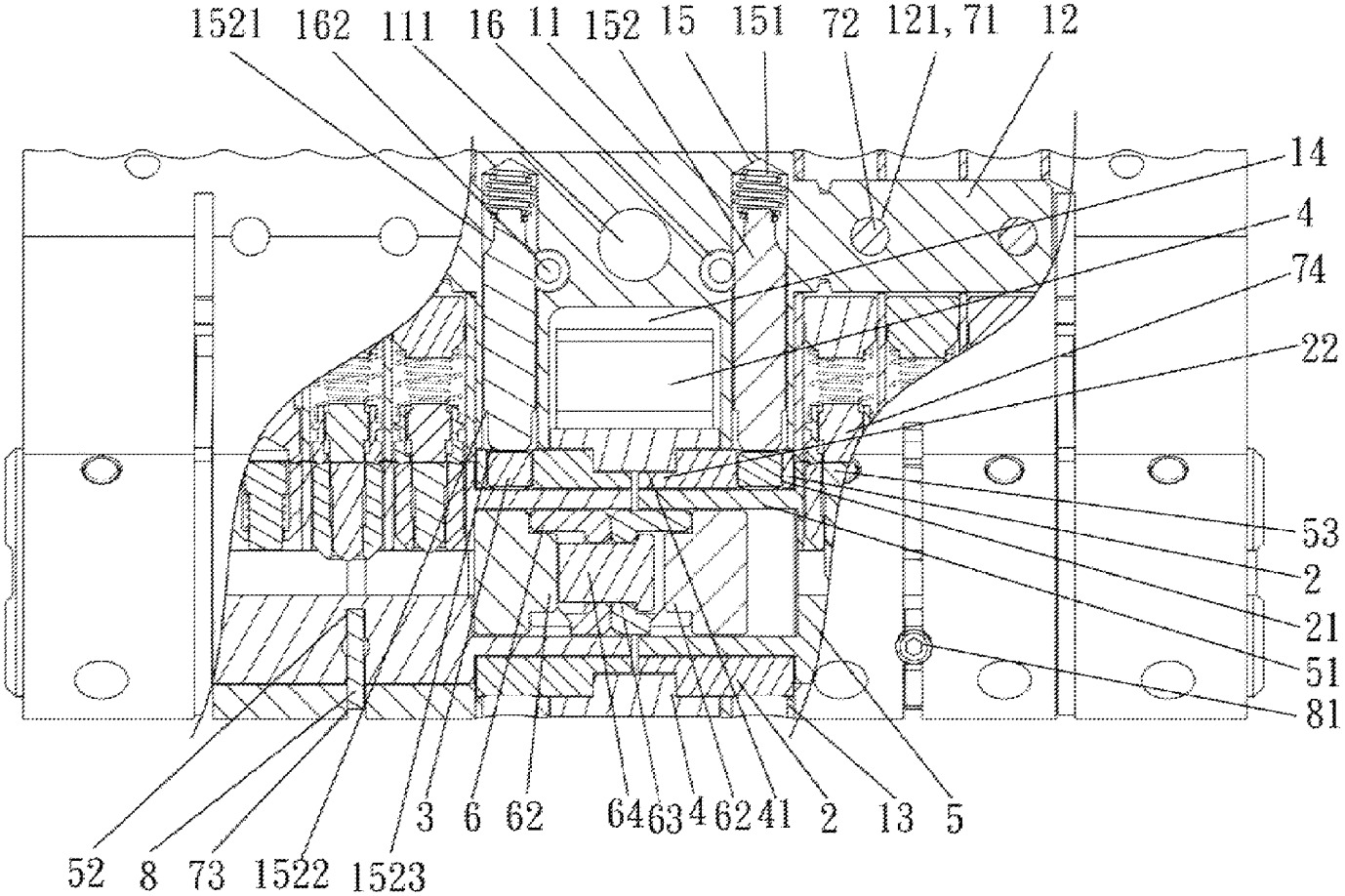
FIG. 7 is a cross sectional view, taken along line B-B in FIG. 5.
Figure 8:
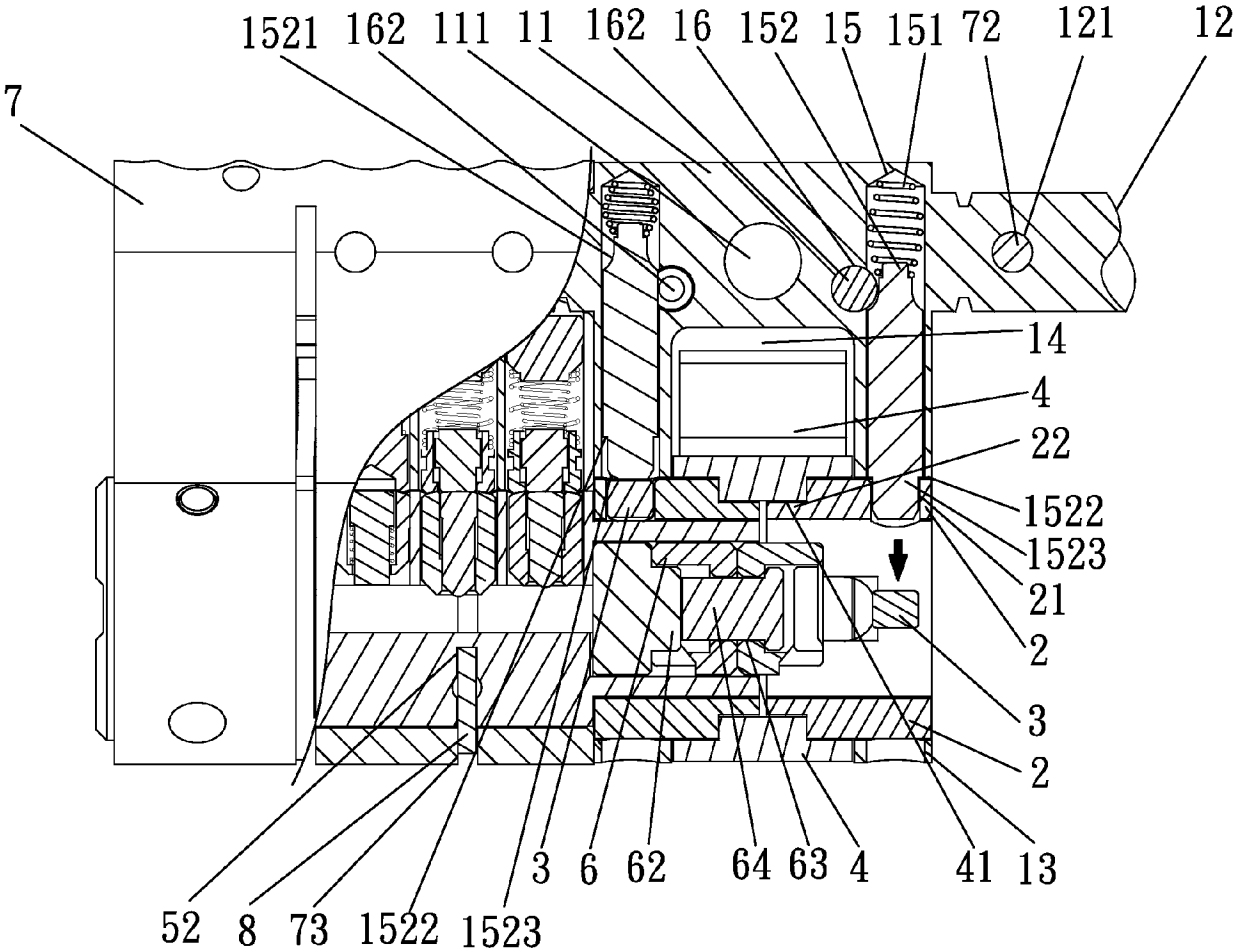
FIG. 8 shows that the sleeve is damaged and the core is taken out.
Figure 13:
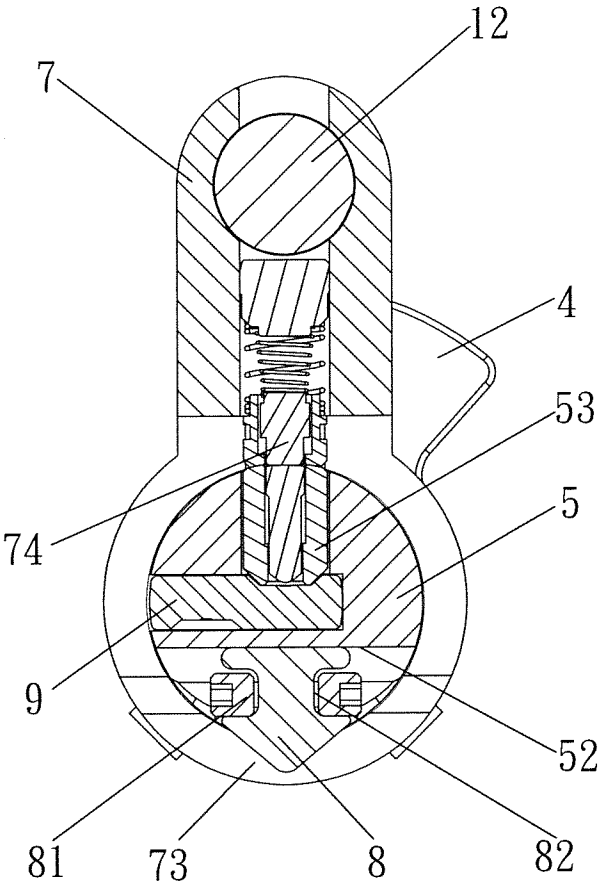
FIG. 13 is a cross sectional view, taken along line E-E in FIG. 5.
Figure 14:
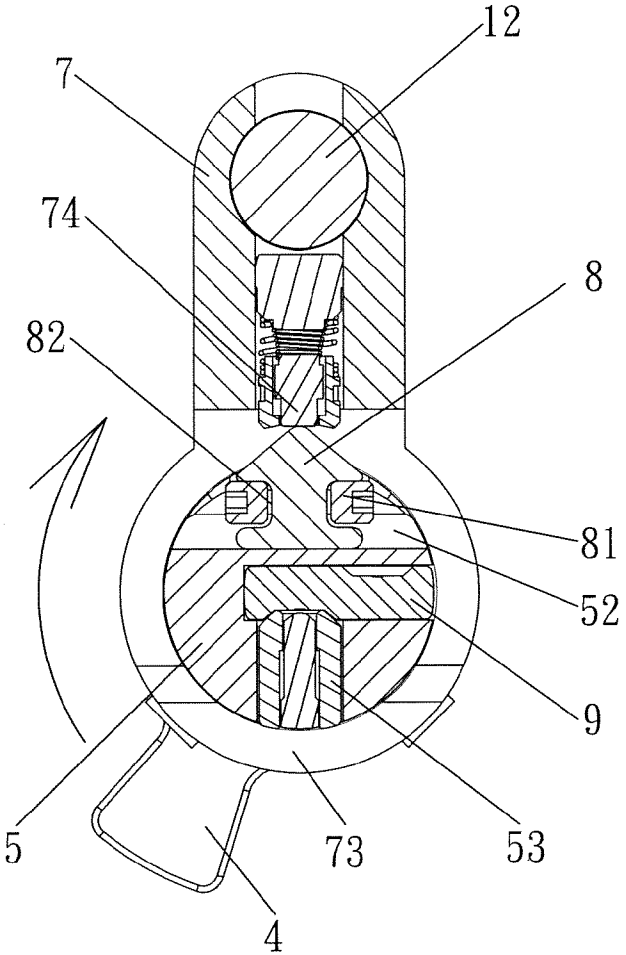
FIG. 14 is a cross sectional view to show the core in FIG. 13 is rotated.

As shown in FIGS. 6, 7 and 13, the sleeve 7 has at least one slit 73 and the core 5 has a groove 52 which is located corresponding to the at least one slit 73. The groove 52 has a positioning plate 8 extending therefrom and the positioning plate 8 reaches the sleeve 7. The groove 52 has two locking pieces 81 on two ends thereof and the locking pieces 81 clamp the positioning plate 8 so as to fix the core 5 to the sleeve 7 and the core 5 is not easily taken out from the sleeve 7. As shown in FIG. 14, when the key 9 is completely inserted into the core 5, the at least one bottom bead 53 and the positioning plate 8 are simultaneously rotated. Because the sleeve 7 receives the at least one top bead 74 in the top bead recess, and the positioning plate 8 reaches the sleeve 7, so that when the positioning plate 8 is rotated to the position where the at least one top bead 74 is located, the at least one top bead 74 is pushed and passes through the top bead recess of the sleeve 7. Therefore, the length of the case 1, the sleeve 7 and the core 5 can be reduced, while five sets of top beads 74 and bottom beads 53 are able to be installed to the sleeve 7 and the core 5 on one end of the lock and this meets the requirements of the international standard for locks and has 30,000 combination numbers.

The present invention has the following advantages:

The two rods 12 on the two ends of the case 1 are connected to two sleeves 7 of different lengths, and the engaging blocks 2 and the driving members 6 are connected with the cores 5 of different lengths, so that the lock has multiple sets of combination numbers. The case 1 of the present invention is modularized so as to reduce the cost of inventory. The users can use the original cores 5 and sleeves 7 to be cooperated with the case 1 of the present invention to improve the safety feature. The users do not need to change the cores 5 and keys 9, and this makes the present invention be used in wider range.

The lock of the present invention can be equipped with one core 5 in the one passage 15 at one side of the lock. Alternatively, the body 11 may have two passages 15 which are located symmetrically to each other so that the lock can be locked or unlocked from both sides thereof. Even if the sleeve 7 on one end is damaged, the user can rotate the cam 4 from the other end to unlock the lock. When the sleeve 7 is damaged and the core 5 is taken out, the contact portion 1523 is inserted into the recess 21, and the stop pin 152 is removed from the room 16. The engaging member 162 passes through the conjunction portion between the passage 15 and the room 16. The first shoulder 1521 of the stop pin 152 is stopped by the engaging member 162 and cannot move to its initial position. This means that the unauthorized person cannot remove the stop pin 152 from the recess 21 and the lock cannot be unlocked.

The groove 52 has a positioning plate 8 extending therefrom and the positioning plate 8 reaches the sleeve 7. The groove 52 has two locking pieces 81 on two ends thereof and the locking pieces 81 clamp the positioning plate 8 so as to fix the core 5 to the sleeve 7. Therefore, the length of the case 1, the sleeve 7 and the core 5 can be reduced, while five sets of top beads 74 and bottom beads 53 are able to be installed to the sleeve 7 and the core 5 on one end of the lock, and this meets the requirements of the international standard for locks and has 30,000 combination numbers.

While we have shown and described the embodiment in accordance with the present invention, it should be clear to those skilled in the art that further embodiments may be made without departing from the scope of the present invention.

What is claimed is:

1. An anti-break lock comprising:

a case having a body and a fixing hole defined through the body, two rods respectively extending from two ends of the body and two rings extending radially from the body, an axis of the rings and an axis of the rods being parallel to each other, a space defined between the two rings and at least one anti-break locking unit;

said anti-break locking unit comprising a passage in said body which communicates with a first ring of the two rings; an engaging block which is engaged with the first ring, the engaging block having a recess which is located corresponding to the passage and smaller than the passage, a pad is engaged with the recess, the passage is located at an end of the body and a resilient member and a stop pin are received in the passage, the resilient member biases the stop pin which has a first shoulder defined in a first end thereof which faces the resilient member, a second shoulder is defined in a second end of the stop pin and located corresponding to the passage and recess, a contact portion extends from the second shoulder and is located corresponding to the recess; and a room within the body which communicates with the passage, a resilient piece and an engaging member are received in the room, the engaging member is located corresponding to the first shoulder and biased by the resilient piece to contact the stop pin, the contact portion contacts the pad; when the pad is removed from the recess, the stop pin is then pushed by the resilient member to insert the contact portion into the recess, the stop pin is then removed from the room, the engaging member is biased by the resilient piece and passes through a conjunction portion between the passage and the room, the first shoulder of the stop pin is stopped by the engaging member and cannot move to its initial position.

2. The lock as claimed in claim 1, wherein a cam is located in the space and connected to the engaging block of the at least one anti-break locking unit, the at least one anti-break locking unit further comprising a core coupled to the engaging block which is located corresponding to the cam, the pad is pushed by the contact portion and in contact with the core, the engaging block has a stepped surface in an axial direction and a slot, a driving member is located in the engaging block and has a protrusion located corresponding to the slot, the cam has an engaging portion which is located corresponding to the stepped surface, the engaging block and the cam are connected to each other, the cam has an insertion path defined in an inner periphery thereof and the insertion path is located corresponding to the protrusion, the core has a slide slot which is located at an end of the core, the end of the core with the slide slot is connected to the engaging block, the slide slot is located corresponding to the protrusion.

3. The lock as claimed in claim 2, wherein the anti-break lock has two anti-break locking units, with the body having two passages which are located symmetrically to each other and two engaging blocks; the engaging blocks are separately engaged with the rings, the engaging blocks are located symmetrically to each other, each of the cores of the two anti-break locking units has a push member which contacts each driving member of the two anti-break locking units, and the two driving members are located symmetrically to each other, each of the driving members has a central hole and a link extends through the central holes so as to axially move the driving members, when one of the push members is pushed, the driving member axially pushes the protrusion of the other driving member to be removed from the insertion path.

4. The lock as claimed in claim 1, wherein each rod has a sleeve connected thereto, each rod has at least one pin hole, each sleeve has a connection hole which is located corresponding to the at least one pin hole, a positioning pin extends through the at least one pin hole and the corresponding connection hole.

5. The lock as claimed in claim 1, wherein each rod has a sleeve mounted thereto which receives a core, the rings are respectively mounted to the cores, each sleeve has at least one slit and each core has a groove which is located corresponding to the at least one slit, each groove has a positioning plate extending therefrom and each positioning plate extends to the corresponding sleeve, each positioning plate has two notches, each positioning plate of the corresponding groove has two locking pieces on two ends thereof and the locking pieces are fixed to the corresponding notches.

6. An anti-break lock comprising:

a case having a body and two rings extending radially from the body, a space defined between the two rings, the body has at least one passage which communicates with one of the rings, each ring is engaged with an engaging block, at least one engaging block has a recess which is located corresponding to the at least one passage and smaller than the at least one passage, a pad is engaged with the recess, the at least one passage of the body is located at an end of the body and a resilient member and a stop pin are received in the at least one passage, the resilient member biases the stop pin which has a first shoulder defined in a first end thereof which faces the resilient member, a second shoulder is defined in a second end of the stop pin and located corresponding to the at least one passage and the recess, a contact portion extends from the second shoulder and is located corresponding to the recess, the body has a room which communicates with the at least one passage, a resilient piece and an engaging member are received in the room, the engaging member is located corresponding to the first shoulder and biased by the resilient piece to contact the stop pin, the contact portion contacts the pad; when the pad is removed from the recess, the stop pin is then pushed by the resilient member to insert the contact portion into the recess, the stop pin is then removed from the room, the engaging member is biased by the resilient piece and passes through a conjunction portion between the at least one passage and the room, the first shoulder of the stop pin is stopped by the engaging member and cannot move to its initial position.

7. The lock as claimed in claim 6, wherein a cam is located in the space and connected to each engaging block, each engaging block has a core installed thereto which is located corresponding to the cam, the pad of the at least one engaging block is pushed by the contact portion and in contact with the corresponding core, each engaging block has a stepped surface in an axial direction and a slot, a driving member is located in each engaging block and has a protrusion located corresponding to each slot, the cam has an engaging portion which is located corresponding to each stepped surface, each engaging block and the cam are connected to each other, the cam has an insertion path defined in an inner periphery thereof and the insertion path is located corresponding to each protrusion, each core has a slide slot which is located at an end of each core, each end of each core with the slide slot is connected to each engaging block, each slide slot is located corresponding to each protrusion.

8. The lock as claimed in claim 7, wherein the body has two passages which are located symmetrically to each other, two engaging blocks, each with a recess and the engaging blocks are engaged with the rings, the engaging blocks are located symmetrically to each other, each of the cores has a push member which contacts each driving member and the two driving members are located symmetrically to each other, each of the driving members has a central hole and a link extends through the central holes so as to axially move the driving members, when one of the push members is pushed, the driving member axially pushes the protrusion of the other driving member to be removed from the insertion path.

9. The lock as claimed in claim 6, wherein two sleeves are connected to the case and each sleeve has a core received therein, each of the rings are mounted to each core, each sleeve has at least one slit and each core has a groove which is located corresponding to the at least one slit, each groove has a positioning plate extending therefrom and each positioning plate extends to the corresponding sleeve, each positioning plate has two notches, each positioning plate of the corresponding groove has two locking pieces on two ends thereof and the locking pieces are fixed to the corresponding notches.

10. An anti-break lock comprising:

a case having a body and a fixing hole defined through the body, two rods respectively extending from two ends of the body and two rings extending radially from the body, an axis of the rings and an axis of the rods being parallel to each other, a space defined between the two rings;

wherein each rod has a sleeve mounted thereto which receives a core, the rings are respectively mounted to the cores, each sleeve has at least one slit and at least one core has a groove which is located corresponding to the at least one slit, the groove has a positioning plate extending therefrom and the positioning plate extends to the corresponding sleeve, the positioning plate has two notches, the positioning plate has two locking pieces on two ends thereof and the locking pieces are fixed to the notches.

11. The lock as claimed in claim 10, wherein the body has at least one passage which communicates with one of the rings, each ring is engaged with an engaging block, at least one engaging block has a recess which is located corresponding to the at least one passage and smaller than the at least one passage, a pad is engaged with the recess, the at least one passage is located at an end of the body and a resilient member and a stop pin are received in the at least one passage, the resilient member biases the stop pin which has a first shoulder defined in a first end thereof which faces the resilient member, a second shoulder is defined in a second end of the stop pin and located corresponding to the at least one passage and the recess, a contact portion extends from the second shoulder and is located corresponding to the recess, the body has a room which communicates with the at least one passage, a resilient piece and an engaging member are received in the room, the engaging member is located corresponding to the first shoulder and biased by the resilient piece to contact the stop pin, the contact portion contacts the pad; when the pad is removed from the recess, the stop pin is then pushed by the resilient member to insert the contact portion into the recess, the stop pin is then removed from the room, the engaging member is biased by the resilient piece and passes through a conjunction portion between the at least one passage and the room, the first shoulder of the stop pin is stopped by the engaging member and cannot move to its initial position.

12. The lock as claimed in claim 11, wherein a cam is located in the space and connected to the at least one engaging block, the at least one engaging block has a core installed thereto which is located corresponding to the cam, the pad of the at least one engaging block is pushed by the contact portion and in contact with the core, the at least one engaging block has a stepped surface in an axial direction and a slot, a driving member is located in the at least one engaging block and has a protrusion located corresponding to the slot, the cam has an engaging portion which is located corresponding to the stepped surface, the at least one engaging block and the cam are connected to each other, the cam has an insertion path defined in an inner periphery thereof and the insertion path is located corresponding to the protrusion, the core has a slide slot which is located at an end of the core, the end of the core with the slide slot is connected to the at least one engaging block, the slide slot is located corresponding to the protrusion.

13. The lock as claimed in claim 12, wherein the body has two passages which are located symmetrically to each other and two engaging blocks with corresponding cores and driving members; the engaging blocks are engaged with the rings, the engaging blocks are located symmetrically to each other, each of the cores has a push member which contacts each driving member, and the two driving members are located symmetrically to each other, each of the driving members has a central hole and a link extends through the central holes so as to axially move the driving members, when one of the push members is pushed, the driving member axially pushes the protrusion of the other driving member to be removed from the insertion path.

14. The lock as claimed in claim 10, wherein a sleeve is connected to each rod which has at least one pin hole, each sleeve has a connection hole which is located corresponding to the at least one pin hole, a positioning pin extends through the at least one pin hole and the corresponding connection hole.

* * * * *